US005400014A

United States Patent [19]

Behlke et al.

[11] Patent Number: 5,400,014

[45] Date of Patent: Mar. 21, 1995

[54] SMOKE DETECTOR WITH DARK CHAMBER

[75] Inventors: George E. Behlke, Victor; Robert E. Walters, Webster, both of N.Y.

[73] Assignee: Detection Systems, Inc., Fairport, N.Y.

[21] Appl. No.: 89,538

[22] Filed: Jul. 12, 1993

[51] Int. Cl.[6] ..... G08B 17/10

[52] U.S. Cl. ..... 340/630; 340/628; 250/574; 356/338

[58] Field of Search ..... 340/628, 629, 630; 250/574, 485.1, 338.3; 356/43, 51, 337, 338

[56] References Cited

U.S. PATENT DOCUMENTS

| | | | |
|---|---|---|---|
| 3,681,603 | 8/1972 | Scheidweiler et al. | 340/630 X |
| 4,672,217 | 6/1987 | Dobrzanski | 340/630 X |
| 4,758,733 | 7/1988 | Mochizuki | 340/630 X |
| 4,857,895 | 8/1989 | Kaprelian | 340/630 |
| 4,897,634 | 1/1990 | Sawa et al. | 340/630 |
| 5,138,302 | 8/1992 | Nagaoka et al. | 340/630 |

*Primary Examiner*—Jeffery A. Hofsass
*Attorney, Agent, or Firm*—J. Addison Mathews

[57] ABSTRACT

A smoke detector includes a dark chamber surrounded by a peripheral wall structure having a plurality of nested vanes. The second element of each vane is shorter than the first, and intersects the first element intermediate its ends at an acute angle. Adjacent vanes define a tortuous path that requires a minimum of three, and in most cases four, reflections for light to reach the inside of the chamber. Adjacent vanes define twisted channels leading from outside the chamber into the chamber for blocking light without substantially restricting the flow of air. The channels each include an outer section that extends in a direction toward the center of said chamber to define a channel entrance that admits airborne smoke with approximately equal resistance from opposite directions. The channels also define second and third sections that bend inwardly from the entrance toward said chamber, first in one direction and then sharply in another direction.

5 Claims, 5 Drawing Sheets

FIG. 1
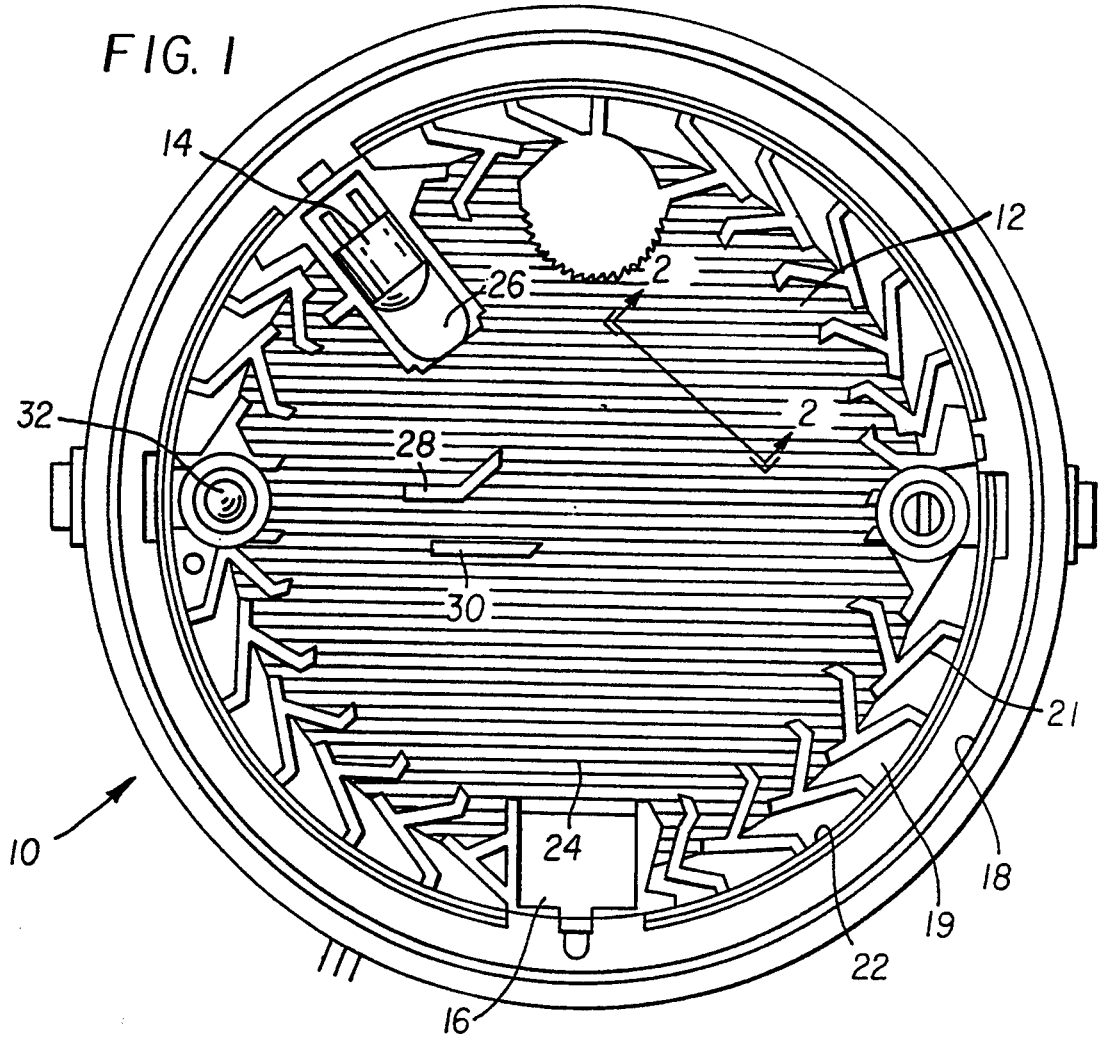
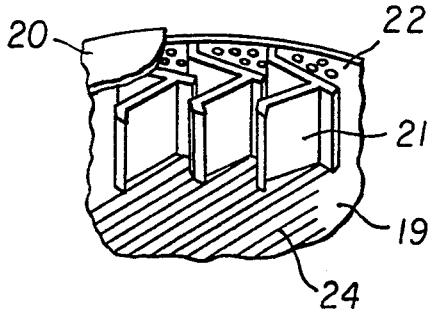
FIG. 2

SMOKE DETECTOR WITH DARK CHAMBER

BACKGROUND OF THE INVENTION

1. Field of Invention

The invention relates to smoke detectors having dark chambers and more specifically to structure for blocking light from the chamber and controlling light reflections within the chamber without significantly impeding the circulation of airborne particles such as smoke.

2. Description of the Prior Art

Prior art smoke detectors typically include a dark chamber through which airborne particles of smoke are free to circulate. An emitter within the chamber directs infrared radiation along a defined path, while a photoelectric sensor, positioned out of the path, is aimed to view the chamber and any radiation scattered by circulating smoke. When the sensor detects a level of scattering above a predetermined threshold, it issues an alarm signal.

The dark chamber usually has a cylindrical configuration including top and bottom walls sometimes separated by a labyrinth structure that blocks light from the chamber but not smoke. Kawai U.S. Pat. No. 4,851,819, issued on Jul. 25, 1989, is an example including a plurality of "L-shaped" wall elements that also suppress internal scattering from the surfaces of the chamber.

PROBLEM SOLVED BY THE INVENTION

Although prior art devices block direct illumination from the chamber, some light enters through the peripheral wall structure after only two reflections and many light rays reach the inside after only three reflections. These reflected rays are attenuated, compared to direct illumination of the chamber, but still reduce performance from desired levels.

Labyrinth structures in the prior art also suffer from directional characteristics. Smoke circulating in one direction, i.e. counterclockwise, may enter the chamber more easily than smoke circulating in the opposite direction, i.e. clockwise. Calibration of the detector is more difficult for a uniform response under a variety of potential circulation patterns.

SUMMARY OF THE INVENTION

The present invention is directed to overcoming the above and other problems presently existing in the prior art, while, at the same time, maintaining existing advantages. Briefly summarized, according to one aspect of the invention, a smoke detector is provided including a dark chamber surrounded by a peripheral wall structure having a plurality of nested vanes. Adjacent vanes define a tortuous path that requires a minimum of three, and in most cases four or more, reflections for light to reach the inside of the chamber.

According to more specific features of the invention, the vanes include first and second elements that intersect at an acute angle. The first element of one vane is nested between the first and second elements of the next adjacent vane. The second element of each vane is shorter than the first, and intersects the first element intermediate its ends. The first and second elements also include bent end sections, according to a more specific feature, which lie substantially in a single plane passing through the central portion of the chamber.

According to still other features, adjacent vanes define twisted channels leading from outside the chamber into the chamber for blocking light without substantially restricting the flow of air. The channels each include an outer section that extends in a direction toward the center of said chamber to define a channel entrance that admits airborne smoke with approximately equal resistance from opposite directions (i.e. counterclockwise or clockwise). The channels also define second and third sections that bend inwardly from the entrance toward said chamber, first in one direction and then sharply in another direction.

According to yet another feature of the invention, the channels include a forth section extending from the third section toward the central portion of the chamber in approximately the same direction as the first channel section. The forth channel section is defined by vanes including surfaces facing the inside of the chamber that are chamfered to reduce undesirable internal scattering of the infrared radiation beam.

The invention improves smoke detector functions by reducing the light level inside the dark chamber without significantly increasing the resistance to airflow. It also reduces the directionality of airflow and improves the uniformity of operation under a variety of airflow conditions.

These and other features and advantages of the invention will be more clearly understood and appreciated from a review of the detailed description of the preferred embodiments and appended claims, and be reference to the accompanying drawings.

BRIEF DESCRIPTION OF THE DRAWINGS

FIG. 1 is a top plan view of a smoke detector with the top removed, including an infrared emitter and optical sensor on opposite sides of a dark chamber.

FIG. 2 is a partial perspective view taken from section 2—2 in FIG. 1, showing more detail of the peripheral wall structure of the dark chamber.

DESCRIPTION OF THE PREFERRED EMBODIMENTS

Figure 3:
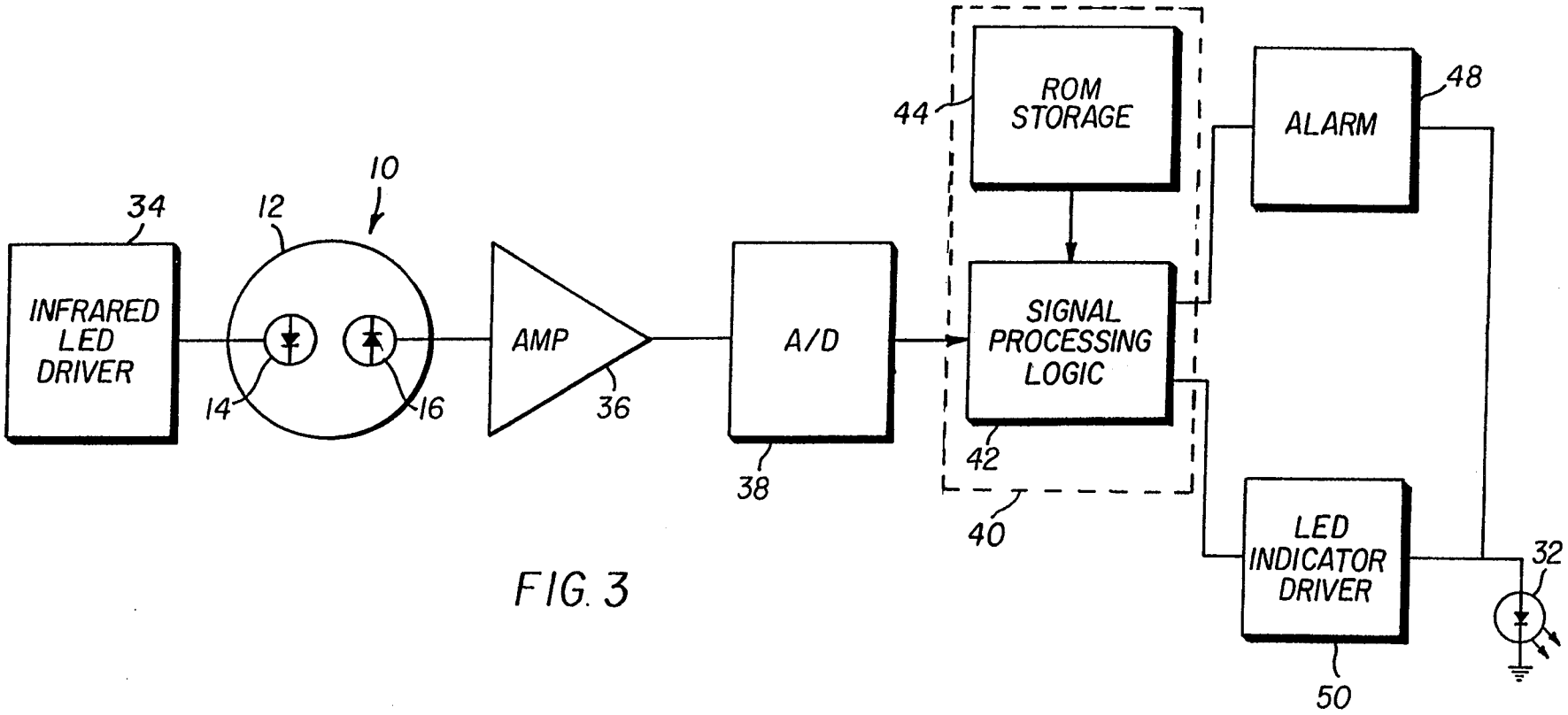
FIG. 3 is a block diagram depicting the electrical operation of the smoke detector.

Referring now to FIGS. 1 and 2, a preferred embodiment of a smoke detector 10 is depicted in accordance with the present invention, including a dark chamber 12 containing an infrared emitter 14 and an optical sensor 16 in the form of a photo detector sensitive to the infrared wavelengths of the emitter 14.

The chamber 12 is defined by a hollow base 18 and cap including a bottom or floor 19 and top or covering wall 20 separated by a peripheral wall structure 21 comprising a plurality of nested vanes. The vanes define a tortuous path for blocking external ambient light from the chamber with minimal interference to the circulation of the airborne particles in smoke. A fine-mesh screen 22 surrounds the periphery of the chamber around the vanes and is sandwiched between the floor and cover to block insects and large dust particles from the chamber. The mesh size is chosen to provide minimal resistance to the passage of smoke particles, particularly those particles of a size and type generated by a fire during its early stages of development.

The interior surfaces of the chamber are black and shaped to deflect any incident light away from the optical sensor 16. The floor and cover include reticulated surfaces 24, for example, to reduce reflections within the chamber.

The emitter 14 and optical sensor 16 are positioned on opposite sides of the chamber, at an angle of approximately 140 degrees, to optimize the response of the detector to a variety of typical smoke particles. The emitter is a light emitting diode (LED), operating in the infrared, which directs a beam or spot of radiation across the chamber. The spot is confined by apertures 26 defined by mating surfaces of the floor and cover. Upstanding baffles 28 and 30 provide a dual septum that blocks the optical sensor from directly viewing the emitter and further confines the beam to its desired path.

The optical sensor 16 includes a photo diode mounted out of the path of direct radiation, but aimed to view the chamber and any radiation scattered or reflected from the path by circulating smoke particles. Although not apparent from the drawings, the photo diode actually is below the chamber and light is reflected to it by a prism and focused on it by a lens.

Under clean-ambient conditions, the background scatter, or level of infrared radiation reflected by the chamber into the sensing element 16, is low. When airborne smoke enters the chamber, the amount of radiation reflected out of the illumination path and into the optical sensor increases. The electrical output of the optical sensor is proportional to the reflected radiation entering the sensor, and when the resulting signal exceeds a predetermined threshold, an alarm is activated. The alarm may include visual or audible warnings issued from the alarm itself or from external generators connected to the alarm typically through a control panel. One such warning device illustrated in FIG. 1 is a light emitting diode (LED) 32, operating in visible wavelengths.

Referring now to FIG. 3, the emitter 14 is pulsed on for one hundred and fifty microseconds (150$\mu$ sec.) every seven seconds (7 sec.) by a temperature compensated current driver 34. The output of the optical sensor 16 is amplified by an operational amplifier 36, configured as a DC coupled current amplifier. After amplification, the signal is converted from an analog to a digital representation of the sensor output by a sample and hold circuit and analog-to-digital (A/D) converter 38.

Operation of the smoke detector is controlled by a micro controller 40 including signal processing logic 42, and write once and Read Only Memory (ROM) 44. The micro controller establishes the timing of the emitter pulses and coordinates sampling of the sensor output signal in accordance with a timed sequence properly coordinated with the emitter.

Each detector is calibrated during its manufacture by circulating a calibration medium through chamber 12 that represents the lowest percent obscuration per foot that should cause the detector to issue an alarm. When the medium enters the chamber, it reflects infrared energy out of the path of radiation from emitter 14, where it is viewed by optical sensor 16. The output signal that results from the test is measured and stored in ROM storage 44, preferably in digital form, for use by the detector during its operation.

After installation of the detector, and during its operation, the detector repeatedly samples the output from optical sensor 16 and compares the output to the stored value representing an alarm condition. If the sampled value exceeds the alarm threshold, the micro controller activates alarm 48 and energizes visible LED 32 through an appropriate driver 50. In the preferred embodiment, the alarm is activated only after the threshold is exceeded by three successive samples. This reduces the possibility of an alarm caused by transient conditions such as cigarette smoke or airborne dust.

Figure 4:
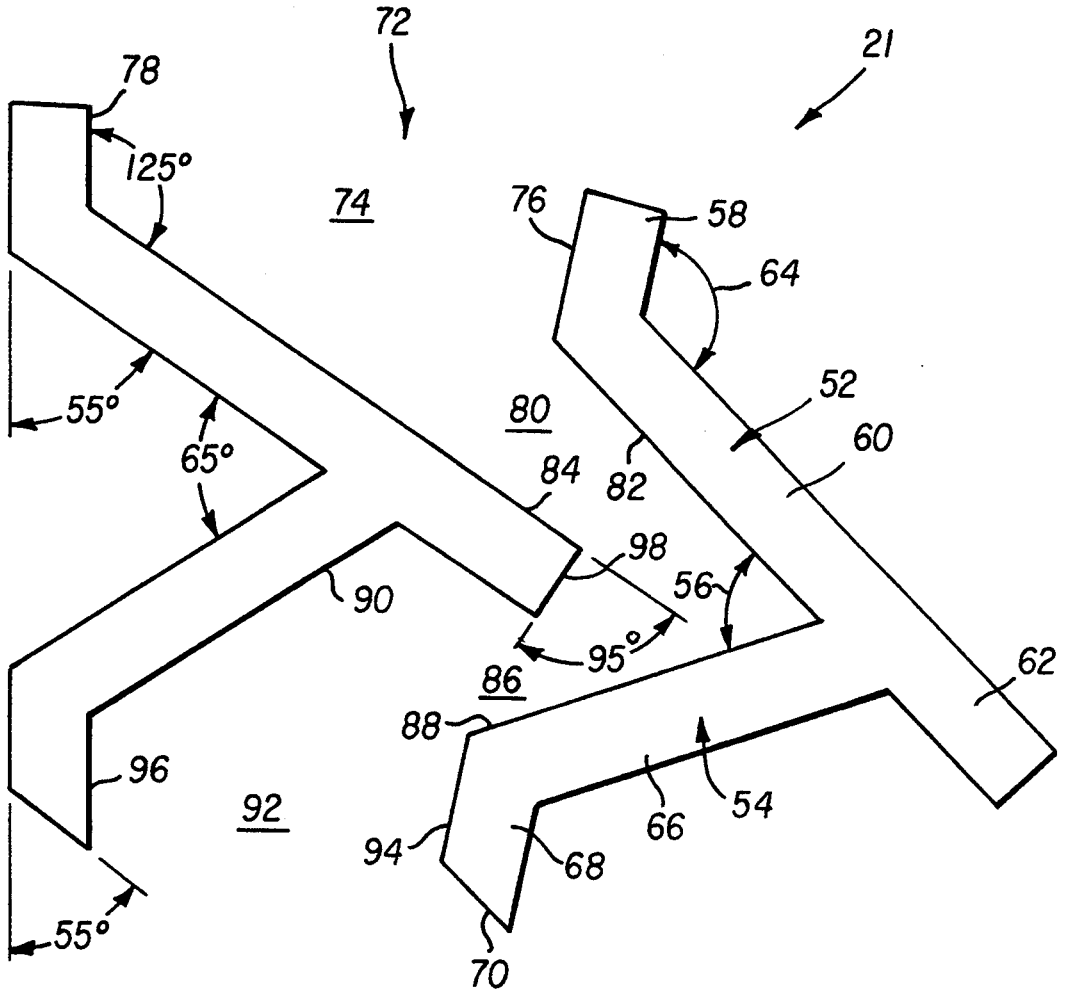
FIG. 4 is an enlarged cross-sectional view of two nested vanes and the channel defined there between, in accordance with the invention.
Figure 5:
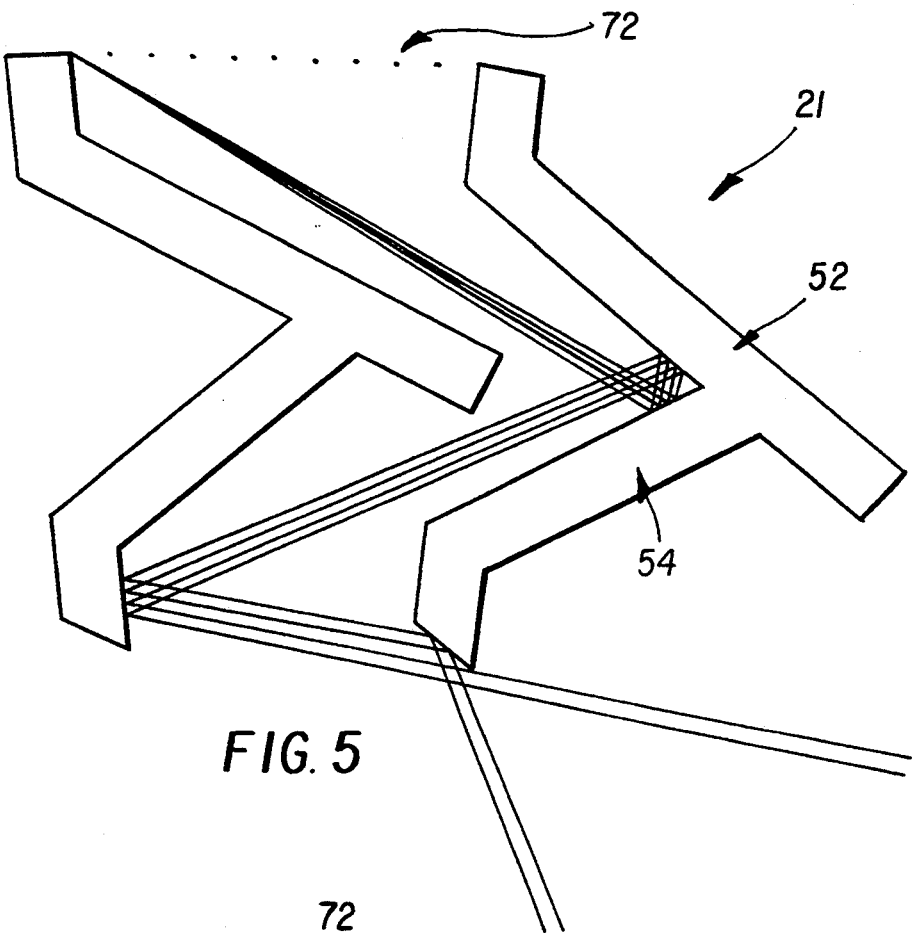
FIGS. 5–8 are cross-sectional views of nested vanes, similar to FIG. 4, depicting examples of light reflections beginning from different positions outside the wall structure and reflecting from various vane surfaces through the wall structure.
Figure 6:
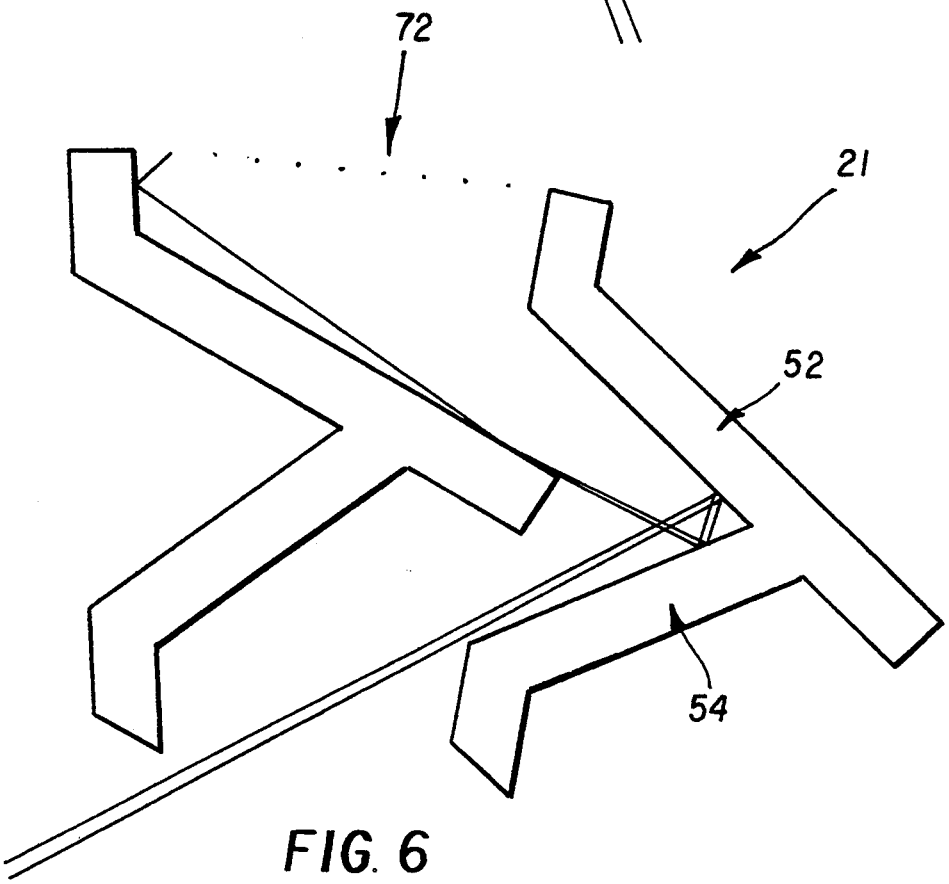
Figure 7:
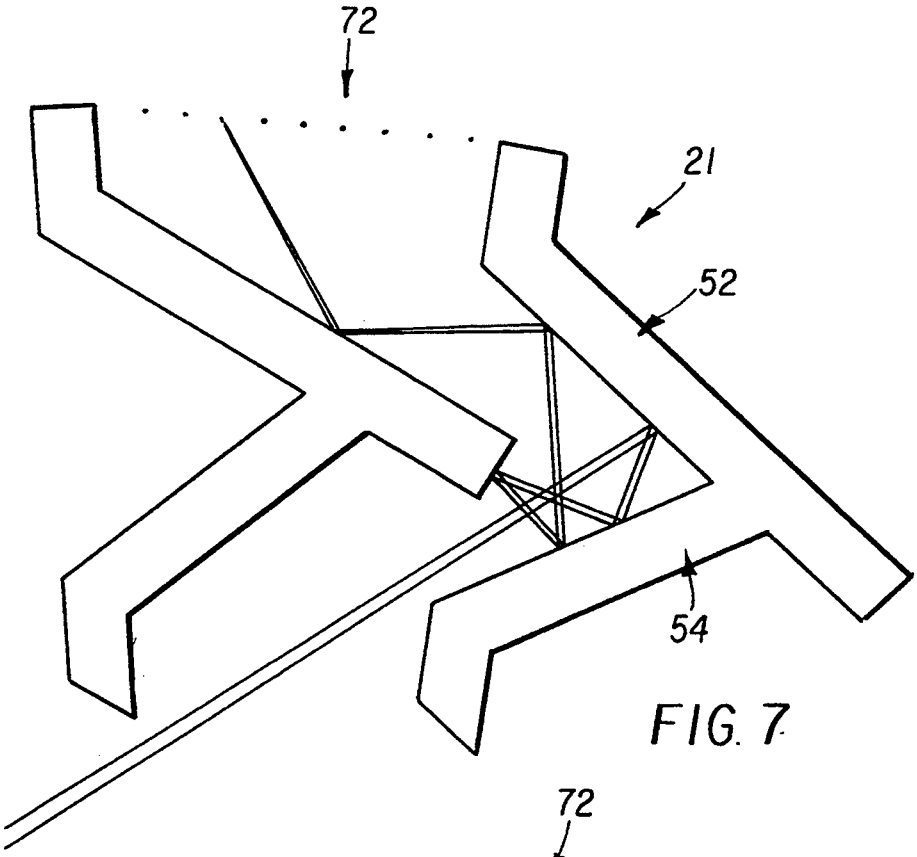
Figure 8:
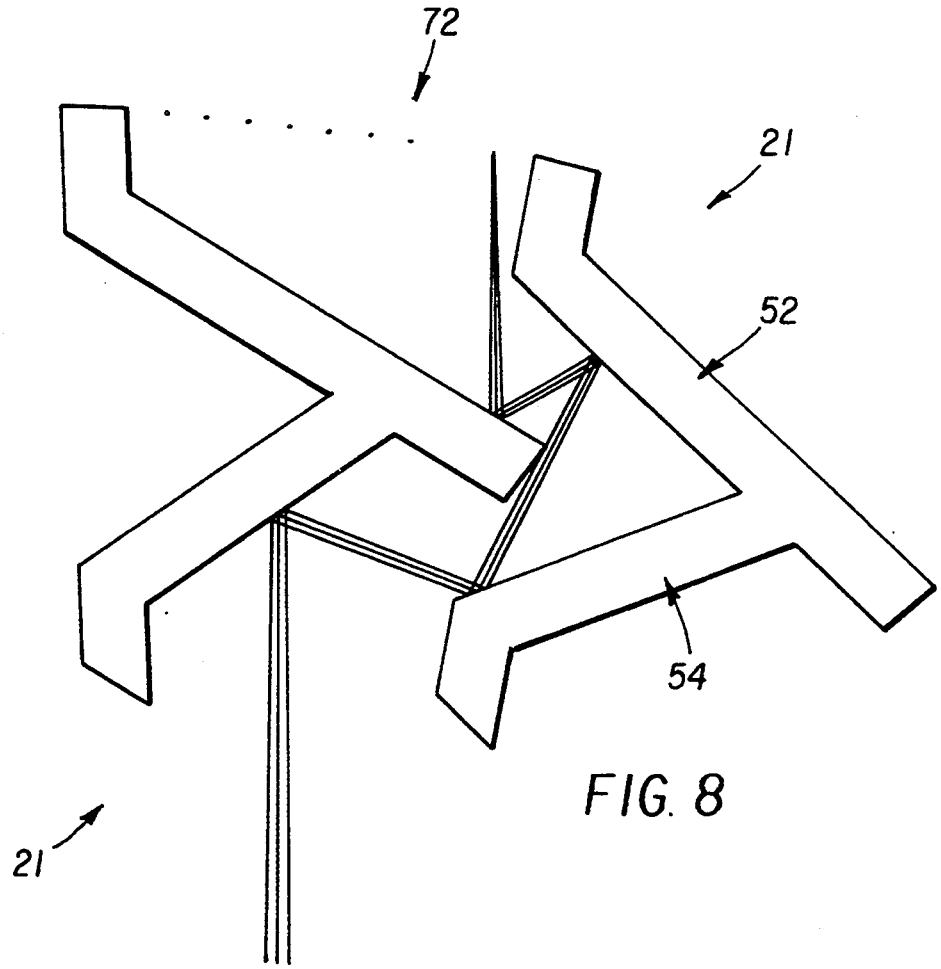

Referring now to FIGS. 1 and 4, and more specifically to the present invention, the wall structure 21 is defined by a plurality of nested vanes or fingers arranged in a cylindrical configuration extending around the periphery of the chamber between the top and bottom walls 19 and 20 thereof. The vanes have several purposes. They block light from the chamber without significantly impeding the flow of airborne smoke particles through the chamber. They define channels for airborne smoke particles that are substantially insensitive to the direction of the airflow approaching the chamber or leaving the chamber. The vanes also reduce or properly direct undesirable scatter of radiation from the emitter inside the chamber that is not caused by smoke.

As depicted in FIG. 4, the nested vanes each include first and second light blocking elements or extensions 52 and 54. The second element 54 is shorter than said first element 52 and intersects the first element at an acute angle 56 intermediate the ends of the first element.

The first elements of each vane include a first section or bent end portion 58, a second section or intermediate portion 60 and a trailing end portion 62. The intermediate portion and trailing end portion of the first element extend in a straight line, but the bent end portion forms an angle 64 of approximately one hundred and twenty five degrees relative to the intermediate portion. The bent end portion 58 also extends substantially along a radius through a central portion of the chamber.

The second elements of each vane include a third section 66 that is straight, and a forth section or bent end portion 68 that extends at an angle of approximately one hundred and twenty degrees from the third section. The forth section is chamfered at its end 70, defining an angle of approximately fifty five degrees. The forth section 68, like the first section 58, extends substantially along a radius through a central portion of the chamber, which is the same radius passing through the first section 58.

The vanes are nested together with the first element 52 of one vane extending between the first and second elements 52 and 54 of the next successive vane to define between adjacent vanes a tortuous path requiring a minimum of three, and in most cases four or more, reflections for light to reach said chamber from outside said chamber.

A plurality of twisted channels 72 are defined between adjacent vanes leading from outside said chamber into said chamber for permitting substantially unrestricted flow of airborne smoke particles both into the chamber and out of the chamber. The channels each include a first or outer section 74, defined between opposed walls 76 and 78, a second section 80, defined between opposed walls 82 and 84, a third section 86, defined between opposed walls 88 and 90, and a forth section 92, defined between opposed walls 94 and 96.

The channel entrance 74 extends in a direction toward the central part of the chamber, thereby providing approximately equal resistance to clockwise and counterclockwise air flow entering the channel. The same is true of the channel exit 92, which, of course acts as an entrance for air circulation leaving the chamber.

The second and third channel sections 80 and 86 extend inwardly toward said chamber from said outer section, bending first in one direction at the second section and then sharply in another direction, forming an acute angle, at the third section. The channel then bends again at the forth section, which extends from the third section toward the central portion of the chamber along substantially the same radius of the chamber as the first channel section.

At the transition point 98 between the second section 84 and the third section 86, the trailing end portion 62 of the first element 52 is angled at approximately ninety five degrees to relieve a somewhat restricted part of the channel without admitting additional light to the chamber.

Referring to FIGS. 5 through 8, examples are depicted of light rays that might enter the chamber from outside the chamber. At least three and in most cases more than three reflections are required for light to reach the chamber. Each reflection attenuates the light to provide a chamber that is essentially dark, yet does not significantly restrict air circulation.

It should now be apparent that an improved smoke detector has been described including a dark chamber defined by top and bottom substantially parallel walls separated by intricate wall structure extending there between for blocking light from the chamber without significantly impeding the flow of airborne particles in smoke. The detector offers reduced directionality for airflow entering and leaving the chamber compared to prior art devices of this type, while retaining many other advantages, such as reduced scattering of infrared radiation by interior surfaces of the detector.

While the invention has been described with particular reference to a preferred embodiment, it should be understood that certain aspects of the invention are not limited to the particular details illustrated. The vane elements might include curved rather that straight elements, for example. It is intended that the claims shall cover all such modifications and applications that do not depart from the true spirit and scope of the invention.

What is claimed is:

1. A smoke detector including a dark chamber having spaced top and bottom walls and peripheral wall structure extending between said top and bottom walls, said peripheral wall structure blocking light from the chamber while permitting the circulation of airborne particles through the chamber, said peripheral wall structure comprising:

a plurality of nested vanes each including first and second extensions intersecting at an acute angle, and defining between adjacent vanes a tortuous path requiring a minimum of three reflections for all light reaching said chamber between said adjacent vanes from outside said chamber.

2. A smoke detector including a dark chamber defined by wall structure separating and extending between top and bottom walls of the chamber, said wall structure comprising:

a plurality of light blocking elements each including first and second sections, said second section being shorter than said first section and joining said first section at an acute angle of less than seventy five degrees intermediate the ends of said first section, said first and second sections each including a bent end portion, wherein the bent end portion of said first section lies substantially in the same plane as the bent end portion of said second section, said light blocking elements being nested together with said first section of one element extending between said first and second sections of the next adjacent element and defining between adjacent elements a tortuous path requiring multiple reflections for light to reach said chamber from outside said chamber.

3. A smoke detector according to claim 2, wherein said bent end portions of said first and second sections respectively extend therefrom in opposite directions, and said plane passes substantially through the center of said chamber.

4. A smoke detector including a dark chamber containing an emitter for directing radiation along a path and a detector for sensing radiation reflected out of the path by smoke particles, said chamber comprising:

substantially planar top and bottom walls spaced in parallel relationship on opposite ends of a substantially cylindrical peripheral wall structure;

said peripheral wall structure including means defining a tortuous path from the outside of said chamber to the inside of said chamber for blocking light from said chamber while permitting air circulation through said chamber, said path defining means including a plurality of nested vanes each including an angled portion and an end portion, said end portion extending at an angle of approximately one hundred and twenty five degrees relative to said angled portion and substantially radially away from the center of the chamber.

5. A smoke detector including a generally cylindrical dark chamber having a peripheral wall structure, said peripheral wall structure comprising:

a plurality of nested vanes defining twisted channels between adjacent vanes leading from outside said chamber into said chamber for blocking light from said chamber without substantially restricting the flow of air into said chamber, said channels each including an outer section defined by opposed walls extending substantially on radii of said chamber, said outer section defining a channel entrance providing approximately equal resistance to clockwise and counterclockwise air flow relative to said channel entrance;

said channels each further including second and third sections extending inwardly toward said chamber from said outer section, said second section bending in one direction relative to said outer section and said third section bending sharply in another direction relative to said second section;

said channels each further defining a fourth section extending inwardly toward said chamber from said third section, said fourth section bending toward the center of said chamber relative to said third section, wherein said outer channel section and said fourth channel section extend along substantially the same radius from the center of said chamber.

* * * * *